United States Patent [19]

Aloupis

[11] 4,025,734

[45] May 24, 1977

[54] AMBIENT NOISE SHIELDED EAR TRANSCEIVER

[76] Inventor: Harry Aloupis, 515 N. Pollard St., Arlington, Va. 22203

[22] Filed: July 27, 1976

[21] Appl. No.: 709,180

[52] U.S. Cl. ..... 179/156 R; 179/107 BC; 179/107 E; 179/121 C

[51] Int. Cl.[2] ..... H04R 1/10; H04R 1/46

[58] Field of Search ..... 179/107 BC, 107 E, 1 P, 179/1 HF, 1 UW, 102, 121 C, 156 R, 157, 182 R

[56] References Cited

UNITED STATES PATENTS

| | | | |
|---|---|---|---|
| 3,087,028 | 4/1963 | Bonnin | 179/156 R |
| 3,869,584 | 3/1975 | Wilde | 179/156 R |

FOREIGN PATENTS OR APPLICATIONS

| | | | |
|---|---|---|---|
| 459,305 | 9/1968 | Switzerland | 179/156 R |

*Primary Examiner*—George G. Stellar
*Attorney, Agent, or Firm*—Shlesinger, Arkwright, Garvey & Dinsmore

[57] ABSTRACT

An earpiece, usually part of a headset, has a funnel-shaped protrusion which extends into the auditory canal of the user. Sound passes through it, and in addition it has electrical transducer elements which pick up speech vibrations.

7 Claims, 10 Drawing Figures

Fig. 1
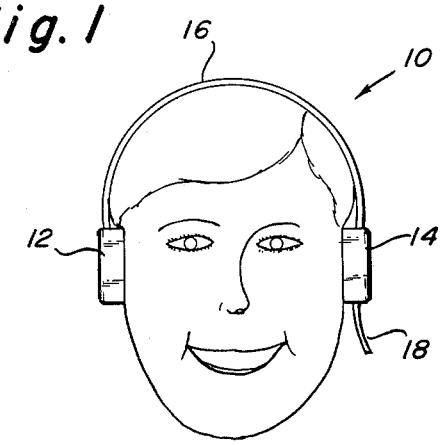
Fig. 2
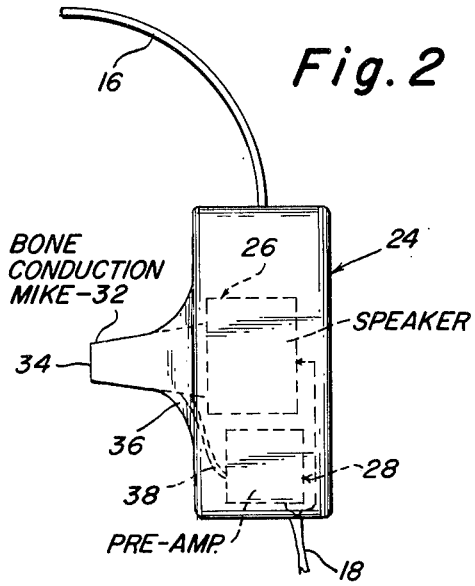
Fig. 3
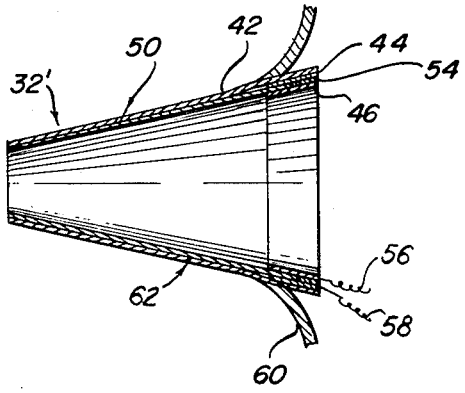
Fig. 4
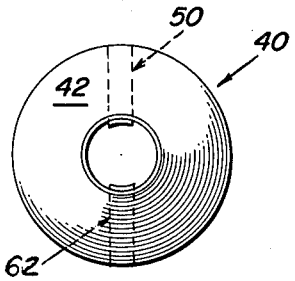
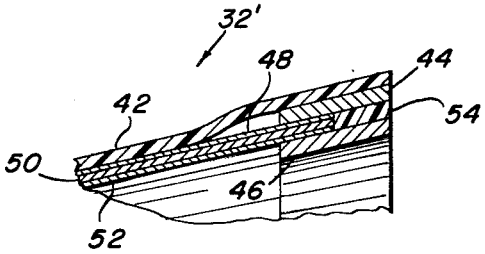
Fig. 5
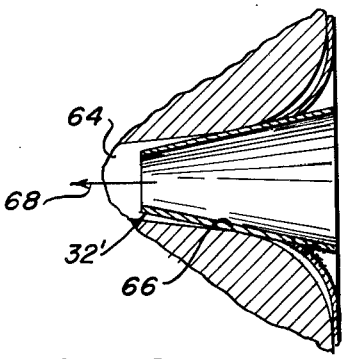
Fig. 6

AMBIENT NOISE SHIELDED EAR TRANSCEIVER

BACKGROUND OF INVENTION

This invention relates to transceiver units, and particularly to a speaker and microphone arrangement for such units.

In many instances, for example in small aircraft or on a motorcycle, substantial background noise presents a problem with respect to clear radio transmission.

In addition, in those situations where the user's hands are occupied, a hand-held microphone is a disadvantage.

The conventional type of headset and hand-held microphone normally used in such situations has the two-fold disadvantage of tying up one of the user's hands, and of transmitting a voice signal which is frequently garbled or drowned out by the background noise.

SUMMARY OF INVENTION

Accordingly, one of the primary features of the invention is to introduce a new microphone and speaker arrangement which will overcome the aforementioned drawbacks of currently used microphone and speaker devices.

Another feature of this invention is a combining of microphone and speaker in a single compact housing in which background noise is effectively eliminated.

A further feature of this apparatus is the providing of a microphone pickup which is always in position requiring no holding by the operator and which is effectively combined with the speaker portion of the unit as part of a unitary device.

Another feature of the invention is the providing of readily wearable speaker and microphone assembly in which the microphone is always held in operable position without requiring it to be held manually and is shielded from extraneous background noises.

Another feature of this invention is the provision of a single compact speaker and microphone assembly combined in a single earpiece.

A still further feature of the invention is the providing of a simple and compact microphone arrangement which is continually operable and is operable by speech vibrations transmitted internally through the user, such arrangement including a pickup which is shielded from external acoustical vibration.

DESCRIPTION OF THE DRAWINGS

FIG. 1 shows one modification of the invention as it would appear in use.

FIG. 2 is a side view of the preferred embodiment of the invention.

FIG. 3 shows a half-section of a funnel-shaped speech vibration pickup assembly.

FIG. 4 is an end view of the device of FIG. 3.

FIG. 5 is an enlarged partial section of FIG. 3.

FIG. 6 is a partial sectional view of the funnel-shaped pickup in position within the auditory canal of the user.

DESCRIPTION

Figure 7:
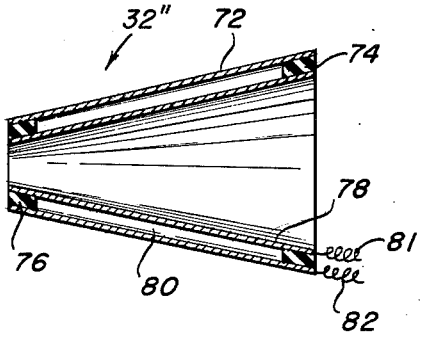
FIG. 7 shows a half section of a second modification of the funnel-shaped speech vibration pickup assembly.

Referring particularly to FIG. 1, the speaker headset of the invention is shown in use. Headphone 12 and 14, are connected by a flexible arcuate member 16 and are firmly held in position over the ears. The headset contains the normal speaker components, and in addition, has bone conductive microphone pickup elements. These are connected by conductor 18 to the transceiver unit itself, not shown.

FIG. 2 shows the headphone with the connecting flexible support member 16 which supports the unit in position on the head of the user. The housng 24 includes a speaker assembly generally indicated at 26, and the preamp electronics 28 for the microphone. These sections are connected through conduit 18 to the remainder of the transceiver, not shown.

The funnel-shaped member 32 which tapers toward the smaller end 34 which is open is flexibly connected to the housing 24 by the flared section 36. Sound from the speaker passes through the funnel-shaped member 32 unimpeded thereby directly into the auditory canal of the user. The casing 24 fits tightly up against and covers the ears of the user shielding out any background noise. The funnel-shaped member also fits snugly into the auditory canal further sealing the ear against extraneous background noises. Sound from the speaker assembly 26 passes directly through the funnel-shaped member and into the auditory canal of the user as indicated by the arrow (FIG. 6) with no sound loss.

The funnel-shaped member 32 also provides a second function in that it serves as the support for a vibration-sensitive electromechanical transducer assembly which is connected by conductors 38 to the preamp electronics section 28. The speaker, preamp electronics, and transceiver portion of the device are of conventional design.

The funnel-shaped voice pickup element contains vibration sensing electromechanical elements, and one such modification is shown in FIGS. 3 to 6. The element generally indicated at 32′ has a pliable plastic covering 42 which would be approximately 1/32 inch thick. It extends the whole length of the element 32′ and is extended over tapered annular support rings 44 and 46.

In this modification, a piezoelectric crystal is used as the vibration sensitive electromechanical transducer. FIG. 5, which is an enlarged view of a portion of FIG. 3, shows in further detail the manner in which it is mounted. Crystal 50 is sandwiched between electroconductive foils 48 and 52. These elements are sandwiched between the outer tapered ring 44 and the matching inner annular ring 46 which firmly and rigidly support the ends of the piezoelectric crystal 50 and its foil pieces. An insulative piece of material 54 is disposed behind the crystal 50 and between rings 44 and 46.

The crystal itself is an elongated strip, as can be seen in FIG. 4 in the dotted outline, and extends the length of the funnel-shaped assembly 32′. The conductive foil strips 48 and 52 extend the same length and are separated from each other by the crystal.

A concave and flexible annular support ring 60 is attached to the upper end of the pliable covering adjacent support ring 44 at its inner periphery, and is attached to the headphone housng at its outer periphery to support the assembly 40.

A second crystal assembly indicated at 62, which is of similar construction as the crystal pickup assembly 50, is shown also in FIGS. 3 and 4 disposed 180° across from the crystal 50. The second crystal 62 is used to insure that the maximum speech vibration signal is obtained. Electrical conductors 56 and 58 are connected to the metal tapered annular support rings 44 and 46 at one end and are connected to the preamplifier electronics in the headphone at the other end.

The manner in which the funnel-shaped voice pickup element is positioned in the ear of the user is shown in FIG. 6. The funnel-shaped element 32' is inserted into the auditory canal 64 making contact with a portion of the canal wall as shown at 66. This contact is firm and at this point vibrations will be transmitted from the auditory canal wall to the crystal pickups 50 and 62 mounted on the funnel-shaped member 32'. The funnel-shaped member, being open, transmits sound from the speaker of the headphone directly therethrough and along the canal as indicated by the arrow 68.

Figure 8:
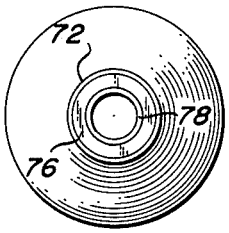
FIG. 8 is an end view of the device of FIG. 7.

FIGS. 7 and 8 show another modification generally indicated at 32'', of another type of microphone transducer pickup element. The funnel-shaped member 32'' has a thin outer plastic wall 72 having an inner conductive surface mounted on a large diameter annular support insulating ring 74 at the large diameter end and a small diameter insulating support ring 76 at the other end. These in turn are mounted upon a rigid conductor hollow, funnel-shaped piece 78 which is spaced from the outer pliable element 72 leaving a space 80 to form a capacitive pickup assembly. Conductors 81 and 82 are connected to the preamplifier section in the headset.

The two funnel-shaped microphone pickup transducers described are typical electrical transducer arrangements that might be employed in this device. It is also possible to use a resistive type of pickup using a carbon-type variable resistive arrangement.

Figure 9:
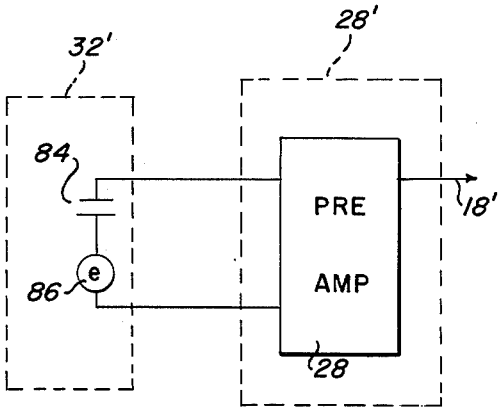
FIG. 9 shows the equivalent circuit for the microphone shown in FIGS. 3 and 4 with pre-amp.

FIG. 9 shows the equivalent electrical circuit for the crystal pickup assembly of FIGS. 3, 4, and 5 with preamp. The capacitive element 84 and the electromotive force generating element 86 are generally indicated within the dotted pickup section 32' which is located in the funnel-shaped member. They are electrically connected to the preamplifier 28 in the pre-amp 28' section which is contained in the headset housing. The signal from the preamplifier section is conducted from the preamplifier along line 18' to the transceiver housing itself.

Figure 10:
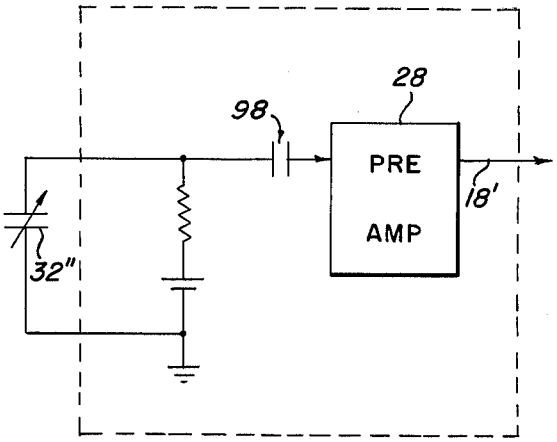
FIG. 10 is the equivalent circuit for the microphone shown in FIGS. 7 and 8 with pre-amp.

FIG. 10 shows the equivalent electrical circit for the capacitive pickup assembly shown in FIGS. 7 and 8 with pre-amp. The variable capacitive element 32'' is located in the funnel-shaped element, and is electrically connected through its two conductors to the amplifier section 28 located in the headset through a capacitive coupling generally indicated at 98. The output from the preamplifier section 28 is carried along conductor 18' to the transceiver itself.

Accordingly, it can be seen that the described invention provides a transceiver in which background noise is eliminated because of the insulated enviroment in which the microphone transducer is placed.

The combination of headphone and microphone in the one singular ear-mounted piece provides, in addition, freedom of movement for the user in that the microphone is always in position and a separate handheld microphone is avoided.

The funnel-shaped piece is configured to fit the auditory canal of any user because of its tapered profile. The dual function of speaker-horn and microphone pickup assembly provides a unique dual function structure.

The funnel-shaped element provides a unique addition to a conventional headphone in which one housing contains the speaker and microphone components ordnarily requiring two separate housings. The arrangement makes it possible to fully take advantage of miniaturized circuitry techniques.

The microphone pickup is mechanically actuated by being held in tight engagement with an area adjacent the headphone which transmits speech vibrations, and is mechanically sensitive to them, rather than to acoustical vibrations as in ordinary microphone pickup. In this regard, it should be noted that the vibration assembly must be held firmly in contact with such portion of the user's head.

Accordingly, it can be seen that there is provided a unique speaker-microphone unit which overcomes the disadvantages of the usual headset and microphone assembly.

While this invention has been described, it will be understood that it is capable of further modification, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What I claim is:

1. An ear transceiver assembly comprising:

a. a headphone housing adapted to be fitted over the ear of the user, b. a speaker assembly contained in the housing and electrically connected to the receiver circuitry of a transceiver unit, c. a funnel-shaped open interior bone conduction microphone assembly contained in and connected to the headphone housing adjacent the speaker assembly and electrically connected to the transmitter circuitry in the transceiver unit, said microphone assembly projects into and firmly engages a portion of the auditory canal of the user and comprises both an electromechanical sensing element and a support element therefore, wherein said speaker assembly is mounted to supply its acoustic output through and unimpeded by said microphone assembly.

2. The ear transceiver assembly as set forth in claim 1, wherein:

a. the electromechanical sensing element is a piezoelectric crystal.

3. The ear transceiver transducer assembly as set forth in claim 2, wherein:

a. the support element is a pliable funnel-shaped piece configured to fit into the auditory canal of the user, and b. the piezoelectric crystal is an elongated element supported in direct contact with the support element along its entire length.

4. The ear transceiver transducer assembly as set forth in claim 1, wherein:

a. the outer engaging surface of the support element forms one plate of the electrical transducer which is a capacitive element.

5. The ear transceiver assembly as set forth in claim 1, wherein:

a. the electromechanical sensing element is a variable capacitor.

6. The ear transceiver transducer assembly as set forth in claim 1, wherein:

a. the outer surface of the support element is resilient.

7. The ear transceiver transducer assembly as set forth in claim 1, wherein:

a. the electromechanical sensing element is more than one piezoelectric crystal.

* * * * *